United States Patent [19]

Lee

[11] 4,304,044

[45] Dec. 8, 1981

[54] METHOD FOR FORMING SELF-REGULATING HEAT TRACE CABLE

[75] Inventor: Maw H. Lee, Cleveland, Ohio

[73] Assignee: The Scott & Fetzer Company, Lakewood, Ohio

[21] Appl. No.: 185,483

[22] Filed: Sep. 9, 1980

Related U.S. Application Data

[62] Division of Ser. No. 95,249, Nov. 19, 1979, Pat. No. 4,250,400.

[51] Int. Cl.[3] ..... H05B 3/00

[52] U.S. Cl. ..... 29/611; 219/549; 338/22 R

[58] Field of Search ..... 29/610 R, 611, 612; 219/528, 552, 541, 553, 548, 549; 174/52 PE; 338/22 R, 214

[56] References Cited

U.S. PATENT DOCUMENTS

| | | | |
|---|---|---|---|
| 2,494,589 | 1/1950 | Sletner | 338/214 X |
| 3,330,034 | 7/1967 | Price | 29/611 |
| 3,621,203 | 11/1971 | Geomini | 219/528 |
| 3,757,086 | 9/1973 | Indoe | 219/528 |
| 3,784,784 | 1/1974 | Geomini | 219/528 X |
| 3,793,716 | 2/1974 | Johannsen | 29/611 |
| 3,858,144 | 12/1974 | Bedard et al | 338/22 R |
| 4,037,083 | 7/1977 | Learner | 219/552 |
| 4,072,848 | 2/1978 | Johnson et al. | 219/528 |
| 4,117,312 | 9/1978 | Johnson et al. | 219/548 |
| 4,120,086 | 10/1978 | Crandell | 29/611 |

*Primary Examiner*—Leon Gilden

*Attorney, Agent, or Firm*—Pearne, Gordon, Sessions, McCoy & Granger

[57] ABSTRACT

Electrically parallel but positionally serial, helically wound segments of heating wire in a cable are each controlled by a chip (thermistor) and are connected to the cable proper by wrapping around notches formed in the insulation of the cable proper at first one side and then the other of the cable. The inner and outer-faces of each chip are connected into each segment by direct contact or by leads at spaced points between which the heating wire is severed. An extruded casing is shrunk-fit over the other parts.

3 Claims, 5 Drawing Figures

METHOD FOR FORMING SELF-REGULATING HEAT TRACE CABLE

This is a division, of application Ser. No. 95,249 filed Nov. 19, 1979 now U.S. Pat. No. 4,250,400.

BACKGROUND OF THE INVENTION

This invention relates to flexible heating cables and particularly to temperature-regulated heating cables useful in the heat tracing of pipes or the like to maintain such pipes at or above a predetermined temperature regardless of ambient conditions.

Most prior art heat tracing cables utilize a pair of insulated power lines helically wrapped along their common length by resistance wire segments each connected across the power lines to provide constant power at a fixed line voltage. Constant power resistance wire heat tracing cables are illustrated by U.S. Pat. Nos. 3,757,086 and 4,037,083.

This in turn means that to assure attainment of a desired minimum temperature throughout such length, the coolest spot must be heated to that temperature whereby other locations are necessarily heated to higher temperatures, thereby wasting power.

Temperature regulation of such a prior art resistance wire heat tracing cable is typically provided by a separate thermostatic control responsive to the temperature of the associated traced pipe. The thermostatic control regulates cable temperature by initiating or interrupting energization of the power lines across which the resistance wire segments are connected.

Such a heat tracing system utilizing separate thermostatic controls and constant power cables energized via the controls possesses obvious disadvantages in the areas of cost, complexity and reliability. In particular, uniformity of temperature along the length of cable controlled by a thermostat cannot be achieved to the extent that ambient conditions vary along such length. Such lengths typically comprise many meters, so that considerable temperature variation may occur.

It is recognized in the art that a heat tracing cable utilizing integral temperature-responsive means for regulating cable energization is highly desirable. Elimination of separate thermostatic controls significantly simplifies the installation and maintenance of a heat tracing system and distribution of control along the cable length achieves uniformity of temperature.

In prior art attempts to provide temperature self-regulating heating cables, self-regulating heaters or control elements have been distributed along the length of the cable, thereby achieving uniformity of temperature along the length. However, this requires that the total longitudinal extent of the control elements comprise a substantial fraction, or even all, of the length of the cable.

One proposal includes the use of a conductive carbon black extrudate heating element. Such a heating cable is disclosed by U.S. Pat. No. 3,858,144. Here, the control element is equal in total length to the cable. While such a cable may in some applications negate the need for a separate thermostatic control, high cost, limited heat tolerance, limited service life, low maximum temperature, and limited power output offset benefits gained by the elimination of a separate thermostat.

Further prior art attempts to provide an acceptable temperature self-regulating cable include the use of discrete self-limiting heating elements distributed in great number along the length of the heat trace cable so that their total longitudinal extent is a substantial fraction of the cable length. A cable of this type is illustrated by U.S. Pat. No. 4,072,848. While overall cable temperature regulation is provided without the need for a separate thermostatic control, the requirement for high-density longitudinal distribution of heating elements is very costly. This high cost and the limited power output of such heating elements are serious disadvantages.

Still other prior art efforts to overcome the foregoing problems have included the provision of resistance wire which is helically wrapped around the pair of power leads and around temperature-responsive control elements, such as thermistor chips, along the length of the cable, with connections first to one cable and then to the other. Cables of this type are illustrated in FIGS. 3 and 6 of U.S. Pat. No. 4,117,312. However, such cables are difficult to manufacture economically, even though lowered manufacturing costs have been sought to be achieved by various techniques—for example by reliance on pressure contact alone without use of solder or adhesives, as in the pressure contact component of the FIG. 6 construction of U.S. Pat. No. 4,117,312.

In short, how to provide a cable which performs well, where material costs are not unduly high, and whose parts can be efficiently and economically assembled and interconnected on a mass production basis has long presented a problem.

The present invention solves that problem by a novel arrangement of elements that lends itself to efficient and economic assembly and interconnection. According to the present invention, a series of resistive heating segments are first formed by continuously helically wrapping heating wires around a pair of insulated power leads, with the insulation alternately removed from one power lead and then the other at spaced intervals, to provide a series of positionally serial but electrically parallel circuits or resistance heating segments. The wrapping occurs to form a segment prior to the emplacement of a thermistor chip for that segment. After the heating wire is wrapped on the pair of insulated power leads, a chip is placed against the insulated power leads and over the wrapped-on heating wire. The inner face of the chip becomes electrically connected to the portion of the wrapped-on heating wire that underlies the chip. The lead from the outer face of the chip is electrically connected to the wrapped-on heating wire at a location spaced from the first connection. The wrapped-on heating wire is then severed between the two connections so that any current flowing through the heating wire is diverted through the chip to thereby put the chip in series connection with its associated resistive heating segment.

Figure 1:
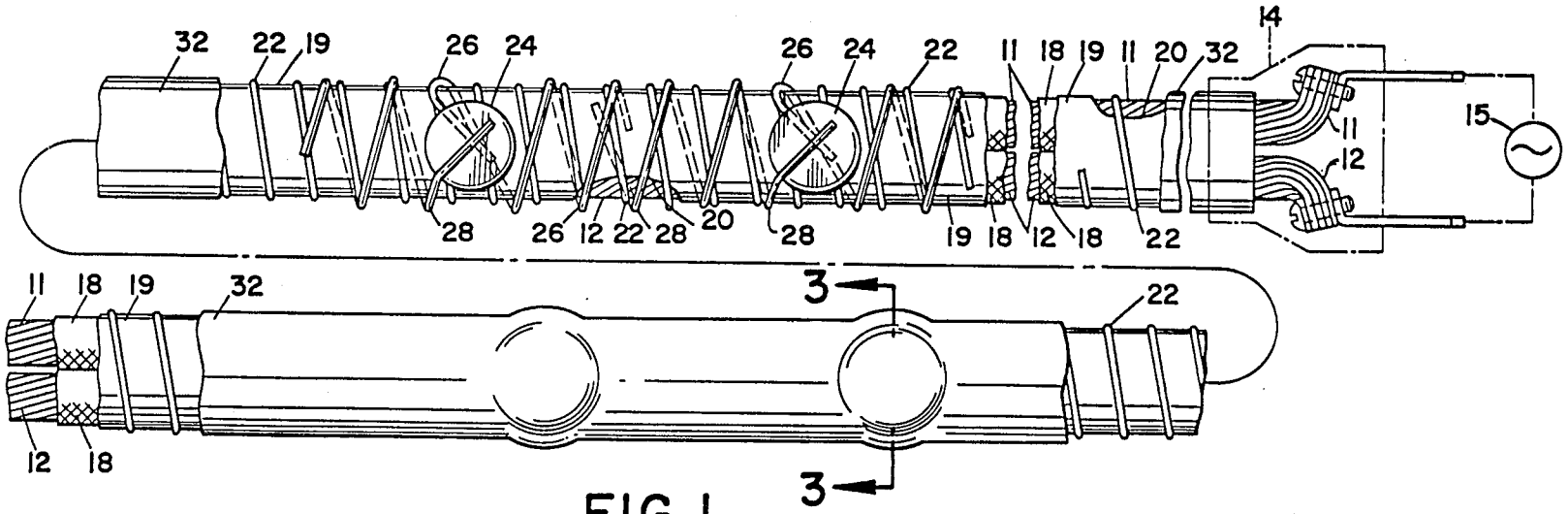
FIG. 1 is a fragmentary plan view, partly broken away, illustrating a heat trace cable embodying the invention, the cable being shown as looped back on itself in order to save space in the illustration.

The heat trace cable shown in FIG. 1 comprises a pair of power leads 11 and 12 extending side by side along the length of the cable and terminating in a plug 14 adapted to connect to a power source 15. Each cable is provided with its own insulation sleeve 18. A single additional thin dielectric sheath 19 may surround the insulation sleeves 18 and thus hold the power leads 11 and 12 and their associated insulation sleeves 18 together to maintain the pair of power leads in associated relationship.

Figure 2:
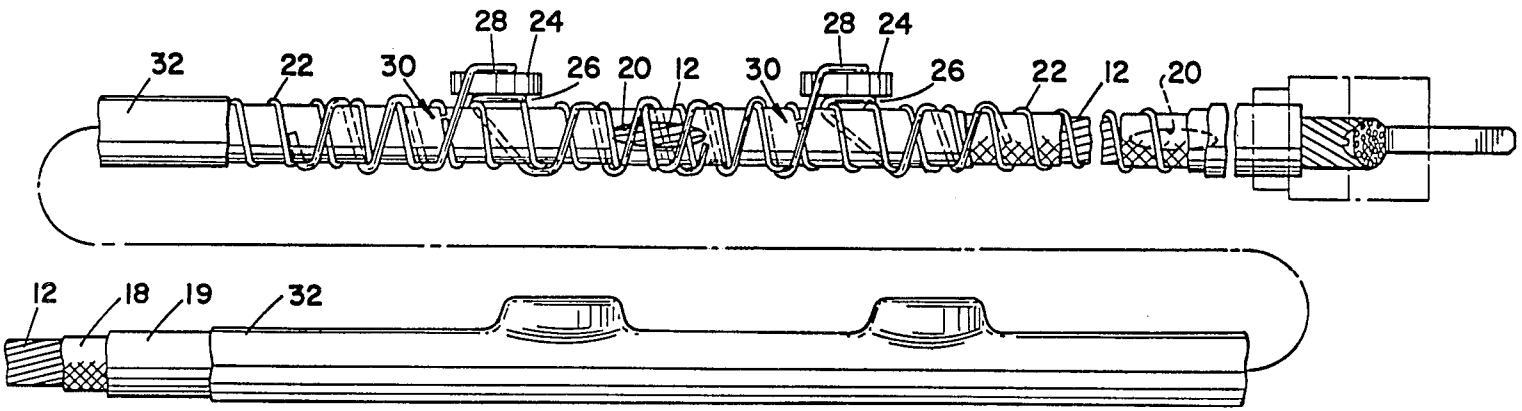
FIG. 2 is a fragmentary side elevation, partly broken away, showing the same cable as FIG. 1, but with an over-and-under relation between the two illustrated reaches rather than the side-by-side relationship shown in FIG. 1.

As seen in the partly broken-away portions of FIGS. 1 and 2, notches 20 are cut through the insulation sleeves 18 at the exterior side of first one and then the other of the power leads 11, 12, and the notches also extend through dielectric sheath 19 if one is provided. While only two of the notches 20 are seen in FIGS. 1 and 2, it will be understood that the notches 20 are distributed along the length of the illustrated cable. Successive notches 20 may be spaced, say, about one yard or one meter from each other along the cable length.

Heating wire 22 is helically wrapped around the pair of power leads 11, 12 and the insulation sleeves 18, and also the dielectric sheath 19 if one is provided. The heating wire 22 extends along the length of the cable and contacts first one of the power leads 11, 12 and then the other through the notches 20. The helically wrapped heating wire 22 thus forms a series of resistive heating segments each connected across the power leads 11, 12 in positionally serial end-to-end relationship but in electrically parallel relationship with the other segments.

Each of the electrically parallel segments has its own temperature-responsive, variable resistance chip 24 for controlling the level of resistive heating in the segment. The chips 24 are positive temperature coefficient thermistors designed to regulate current through the associated segment as a function of thermistor temperature in a known manner. Current regulation, and hence power output (heat dissipation), of each of the segments is independently controlled by the chips 24 associated with the segment. The upper and lower faces of the chips 24 constitute their terminals. Each chip 24 is supported against the insulated pair of power leads 11, 12. The inner-face of each chip 24 overlies and is electrically connected with the helically wrapped heating wire 22. In the example illustrated in FIGS. 1 and 2, the electrical connection is by means of an inner chip lead 26. This lead is in helically wrapped electrical contact with the heating wire 22, and preferably, in the case of the chip seen to the left in FIG. 1, also extends to the adjacent notch 20 for direct contact with one of the power leads. The other chip 24 seen in FIG. 1 is located on the other side of the same notch 20 and therefore its inner chip lead 26 does not directly contact a power lead through a notch, but is wrapped over and in electrical contact with the heating wire 22.

Each chip 24 has an outer chip lead 28 extending from the outer-face of the chip downwardly into contact with the helically wrapped heating wire at an initial contact point spaced on the cable from the location of the inner-face connection established by the inner chip lead 26. The outer chip lead 28 thereby establishes an outer-face connection to the heating wire 22 at such point of initial contact.

Preferably, the outer chip lead of the chip 24 seen to the right of FIG. 1 also extends to the adjacent notch 20 for direct contact with one of the power leads. The other chip 24 seen in FIG. 1 is located on the other side of the same notch 20 and therefore does not make contact with a power lead through a notch, but only with the heating wire 22.

Each chip 24 has associated therewith a break or cut 30 (FIG. 2) in the helically wrapped heating wire 22. Each break 30 is between the inner-face and outer-face electrical connections of the associated chip 24. Thereby, all heating wire current is diverted through the chip and an electrically serial relationship is established between the chip and the one of the electrically parallelly related resistive heating segments with which the chip is associated.

An insulating casing 32 is extruded over all the foregoing elements and may be in shrink-fitted relation therewith, thereby covering and protecting all the elements of the assembly, including the chips 24.

In the cable shown in FIGS. 1 and 2, each notch 20 associated with the power lead 12 has associated therewith two chips 24, each in a different resistive heating segment, while the notches 20 associated with the power lead 11 do not have any chips 24 associated with them but merely accomplish connection of the adjacent heating segments, that are at each side of the notch, to the power lead 11.

The illustrated cable may be economically fabricated by simple notching, wrapping, cutting, and extruding operations. In the final product, each segment is self-regulating independently of the other segments and the longitudinal extent of the chip 24 associated with each segment is only a small fraction of the length of the segment, whereby the longitudinal extents of all the chips totaled together amount to only a small fraction of the length of the cable. The longitudinal extent of each of the electrically parallel segments is only a small fraction of the longitudinal extent of the cable so that the temperature of the cable may be maintained essentially uniform along the length of the cable, despite variation in ambient conditions along its length and despite the very limited total longitudinal extent of the chips taken together.

More specifically, a cable may be made according to the invention by notching the sides of a pair of insulated power leads at spaced locations alternately along the length of the pair of alternately expose the power leads. Then, heating wire may be helically wrapped along the length of the insulated power leads, the wire thereby coming into contact with first one power lead and then the other only at the notches 30 to thereby establish resistive heating segments between successive pairs of notches. Then, for each heating segment, a thermistor chip 24 is fixed against the pair of power leads 11, 12, with the inner-face of the chip mechanically and electrically connected with the heating wire 22, either directly or via an inner chip lead such as 26. Such emplacement of the chip provides a first heating wire hold-down, as well as an inner-face electrical connection of the chip. The outer chip lead 28 is mechanically and electrically connected with the heating wire at a place spaced on the cable from the inner-face connection to establish an outer-face electrical connection. The heating wire is thereby held down, both by the inner-face of the chip (or lead associated therewith) and by the outer chip lead.

The heating wire 22 is then simply severed or cut at any location between the inner-face and outer-face electrical connections of the chip. This severing establishes, for the heating segment associated with the chip, an electrically serial relationship between the chip and the heating wire.

The insulating casing 32 of any suitable plastic material is then extruded around the parts so severed and is shrunk-fit thereon to thereby contribute to the firm anchoring of the parts in assembled position. This may be done by passing the assembly through the center of an extruding die (not shown) while extruding the material of casing 32 from the die proper in surrounding relationship with the assembly in a known manner.

The inner and outer chip leads are illustrated as crossing each other in plan view, as seen for example in FIG. 1, because this is a conventional way to provide such leads. However, the inner ends of each pair of leads may be positioned in parallel, over-and-under relationship to each other (not illustrated) on the upper and lower faces of the chip, extending off the chip in opposite directions, which may simplify the wrapping of the chip leads onto the underlying cable elements.

Figure 3:
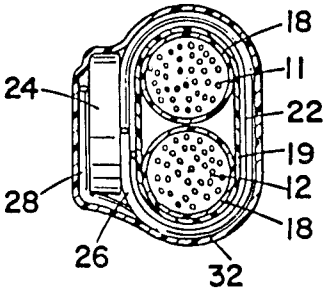
FIG. 3 is a cross section on an enlarged scale, taken on the plane of line 3—3 of FIG. 1.
Figure 4:
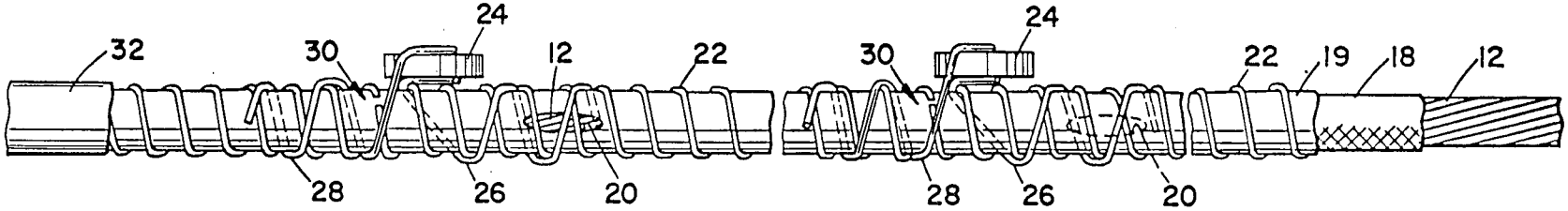
FIGS. 4 and 5 are views similar to the top part of FIG. 2 and illustrating other forms of heat trace cable which embody the invention.

The cable seen in FIG. 4 is generally similar to that shown in FIGS. 1 to 3. However, in FIG. 4, each heating segment has a chip associated with it near its right end, as seen in the figure, so that one chip is associated with each notch 30, rather than a pair of chips being associated with each notch opening to one of the cables 11, 12 and no chips associated with the notches opening to the other cables, as in the constructions of FIGS. 1 to 3.

Figure 5:
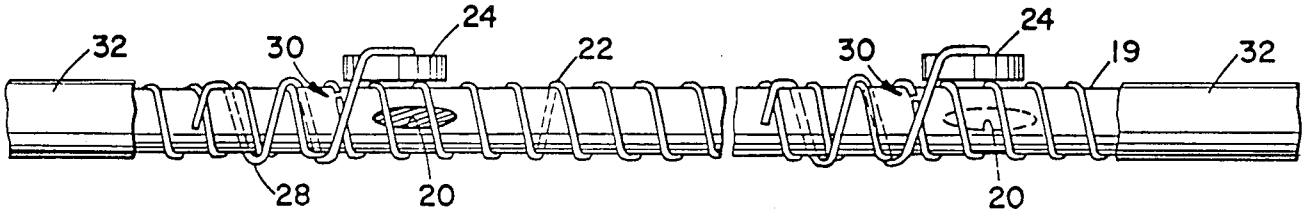

FIG. 5 is similar to FIG. 4, but illustrates a construction wherein the inner-face connection is established by direct contact between the inner-face of each chip 24 and the heating wire 22, without provision of any inner chip lead. The connection from a chip to an associated notch 30 is made via the heating wire 22 without any reliance on an inner chip lead.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of making a flexible heating cable comprising the steps of notching the sides of a pair of insulated power leads at spaced locations alternately along the length of the pair to alternately expose the power leads, helically wrapping heating wire along the length of the insulated power leads and in contact with first one power lead and then the other only at the notches to establish resistive heating segments between successive pairs of notches, then, for each heating segment, fixing a thermistor chip, having a lead at least at its outer-face, against the pair of power leads with the inner-face of the chip mechanically and electrically connected with said heating wire to establish both a first heating wire hold-down and an inner-face electrical connection, and with the chip lead from the outer-face of the chip also mechanically and electrically connected, across a lengthwise gap, with said heating wire to establish both a second heating wire hold-down and an outer-face electrical connection, severing said heating wire at a location within said lengthwise gap between said inner-face and outer-face connections to establish, for the heating segment associated with the chip, an electrically serial relationship between the chip and the heating wire, and forming an insulating casing around the parts so assembled.

2. The method of claim 1, in which the insulation casing is formed by extruding and shrink-fitting the casing material around the assembled parts to contribute to firm anchoring of the parts in position.

3. The method of claim 1, in which the opposite exterior sides of the pair of power leads are notched to make the alternate exposures.

* * * * *